United States Patent [19]

Thiel et al.

[11] Patent Number: 4,760,216

[45] Date of Patent: Jul. 26, 1988

[54] HIGH VOLTAGE BUSHING

[75] Inventors: Peter H. Thiel, Bloomington, Ind.; James R. Gamble, Friendsville, Md.

[73] Assignee: Westinghouse Electric Corp., Pittsburgh, Pa.

[21] Appl. No.: 7,704

[22] Filed: Jan. 28, 1987

[51] Int. Cl.[4] ..... H01B 17/26

[52] U.S. Cl. ..... 174/142; 29/631; 174/152 R

[58] Field of Search ..... 174/50.56, 50.63, 151, 174/152 R, 152 E, 152 GM, 50.58, 50.61, 142; 29/631; 403/179, 272

[56] References Cited

U.S. PATENT DOCUMENTS

| | | | |
|---|---|---|---|
| 2,845,477 | 7/1958 | Kelley et al. | 174/152 R X |
| 2,896,008 | 7/1959 | Putz | 174/50.56 |
| 3,858,378 | 1/1975 | Allen et al. | 403/179 X |
| 4,225,262 | 9/1980 | Koop et al. | 403/272 |

FOREIGN PATENT DOCUMENTS

| | | | |
|---|---|---|---|
| 469496 | 11/1950 | Canada | 174/152 GM |
| 1143878 | 2/1963 | Fed. Rep. of Germany GM | 174/152 |
| 248621 | 5/1926 | Italy | 174/152 R |
| 307647 | 3/1929 | United Kingdom | 174/142 |

*Primary Examiner*—Laramie E. Askin
*Attorney, Agent, or Firm*—L. P. Johns

[57] ABSTRACT

A method for making an electrical bushing having an enlarged intermediate portion and reduced portions at opposite ends. The method is characterized by the steps of mounting an annular flange around one of the reduced portions to form a peripheral gutter adjacent to the one portion, mounting a cap on the other of the reduced portions to form a peripheral gutter adjacent to the other portion, placing a solid solder ring in each gutter, and with the open sides of the gutters upright, heating the solder rings to a molten temperature and cooling the molten solder to below its melting temperature in order to provide a joint between the flange and the one portion and the cap and the other portion.

5 Claims, 1 Drawing Sheet

HIGH VOLTAGE BUSHING

BACKGROUND OF THE INVENTION

1. Field of the Invention

This invention relates to insulating bushings for electrical apparatus, such as a capacitor terminal, and more particularly, it pertains to a high voltage bushing.

2. Description of the Prior Art

Heretofore, high-voltage porcelain bushings have been made from wet-process porcelain, air dried, turned, bone dried, glazed and then fired. Top and bottom hardware was attached by soldering to platinum bands fired in the porcelain. Typically, the porcelain has sloped sheds for increased creepage that are turned during drawing. Shrinkage at firing has been as much as ±3%. The resulting large tolerances required special care in attaching the hardware that was usually secured in place by sufficient solder to produce a finished assembly. More particularly, top hardware and bottom mounting rings were attached in two separate operations with considerable cooling time elapsing between the operations. Moreover, the electrical efficiency of some bushings has not been satisfactory.

SUMMARY OF THE INVENTION

The present invention provides an insulating bushing assembly for extending through the aperture of a wall of an electrical apparatus which assembly comprises an electrically insulating bushing having an enlarged portion and a first reduced end portion, the enlarged portion having an annular shoulder and the reduced end portion having a cylindrical surface; a metallic collar on and around the cylindrical surface and including an integral flange on the annular shoulder; an annular metallic adapter around the first reduced portion for mounting the bushing on the wall, the adapter including a cylindrical portion spaced from the collar on the first reduced portion and forming an annular groove therebetween, and the cylindrical portion including an inturned part adjacent to the integral flange; the bushing having a second reduced portion and having a second metallic collar mounted thereon; a cap on the second reduced portion and having a cylindrical portion around the second metallic collar and forming an annular groove therebetween; and solder bonds in the annular grooves providing a bond between the flange and the cap and their respective first and second reduced portions.

The invention also relates to improved methods for constructing a bushing for mounting in the aperture of electrical apparatus including the steps of providing an electrically insulating bushing having first and second reduced end portions; mounting an annular flange around the first reduced portion which flange forms an annular gutter around the first reduced portion, which gutter has an upturned opening; mounting a cap on the second reduced portion which cap includes a cylindrical flange that forms a peripheral gutter around the second reduced portion, which gutter has an upturned opening; placing solid solder rings in the gutters and thereafter heating the solder rings to molten status and subsequently solidifying the molten solder so as to secure the annular flange and cap in place on the respective reduced end portions.

The advantage of the structure and method of this invention is that it provides a bushing having a more uniform voltage distribution that is conducive to a substantially smaller bushing at lower cost which is produced by a method which eliminates an additional soldering operation at both top and bottom ends by applying the solder joints in a single operation for melting and solidifying the solder.

DESCRIPTION OF THE PREFERRED EMBODIMENT

Figure 2:
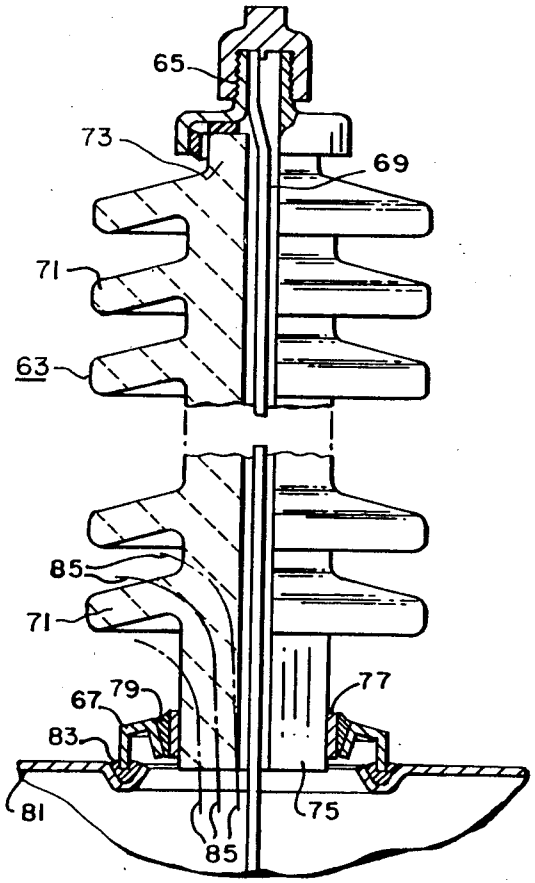
FIG. 2 PRIOR ART
FIG. 2 is an elevational view, partly in section, of a bushing assembly of prior art construction.

In the drawing, a bushing assembly is generally indicated at 1 and it comprises a bushing 3, an adapter 5, a cap or terminal 7, and a high voltage conductor 9. The bushing 3 is composed of an electrically insulating material, such as porcelain, and includes a body portion 11 having sheds 13 and end portions 15, 17 of reduced diameter compared to that of the body portion 11. The bushing 3 also includes an elongated bore 19 through which extends the conductor 9.

In accordance with this invention, the adapter 5 is metallic and includes a cylindrical portion 21, an inturned portion or flange 23, and an outturned or flared portion 25. The bushing 3 includes an annular shoulder 27 at the lower end of the body portion. The lower end portion 15 has a cylindrical surface 29.

An annular collar 31 is disposed around the cylindrical surface 29 and includes an outturned annular flange 33 on the shoulder 27. The collar 31 and flange 33 are integral to cover the corner 35 formed by the shoulder 27 and surface 29, and are metallic (preferably platinum, silver, or copper) and are applied by firing on.

The metallic adapter 5 mounts the bushing 3 in place within an opening 37 of a wall or casing 39 of electrical equipment, such as a capacitor or transformer. For that purpose, the flared portion 25 is secured to a flange 41 of the casing 39 in a suitable manner, such as by a ring of solder 43. Similarly, the inturned portion 23 of the adapter 5 contacts the flange 33 and provides a peripheral space or groove 45 between the cylindrical portion 21 and the collar 31 wherein a ring of solder 47 is disposed.

The cap or terminal 7 is a generally cup-shaped member having a shank 49 and a flange 51. The flange 51 is disposed around the reduced diameter end 17 and forms a space or groove 53 between a metal collar 55 on the outer surface of the end portion 17. A ring of solder 57 is disposed within the space 53 in order to secure the cap or terminal 7 tightly in place.

In addition, the invention includes a method of assembling the bushing with its hardware including the adapter 5 and the cap 7 comprising the steps of: positioning the body portion 11 with end 15 uppermost; mounting the adapter 5 in place; mounting the cap 7 in place over the end of the end portion 17; both the flange and the cap providing solder-receiving spacings between them and their respective bushing end portions; placing solder into said spacings; heating the solder to a molten state; and cooling the solder and surrounding parts sufficiently to cause the solder to solidify from a molten state.

During manufacture, the bushing assembly is inverted so that the grooves 45, 53 have upper open ends into which the solder is inserted so that both solder locations are melted simultaneously.

The bushing assembly 1 utilizes non-sloped sheds 13 that are cut by grinding after drying to the bone-dry state. This results in closer tolerances after glazing and firing such as ±1% tolerance. The hardware including the adapter 5 and the cap 7 is attached preferably by using solid solder rings that are pre-formed, and this virtually eliminates the addition of solder by an operator. Both top and bottom hardware is applied in a single operation using two heat sources to melt the solder rings, thereby reducing the assembly time and expense.

The conductor 9 is preferably a stranded copper wire. The upper end 59 of the conductor is disposed within the bore of the shank 49 where it is secured by a solder joint 61. In this manner a good electrical connection is provided between the several parts including the conductor 9, shank 49, flange 51, collar 55, and a terminal cap which is secured to a threaded portion 52 of the terminal 7.

A bushing assembly of prior art construction (FIG. 2) comprises a bushing 63, a terminal 65, an adapter 67, and a conductor 69. The bushing 63 includes sheds 71 and upper and lower reduced end portions 73, 75. A collar 77 is disposed around the outer surface of the end portion 75, whereat the collar is secured by firing. The adapter 67 is secured on the collar 77 by a ring of solder 79 and on a wall or casing 81 by a ring of solder 83.

During operation, voltage potential lines 85 occur in the lower portion of the bushing 63. The lines 85 are confined to the zone around the collar 77 and the lower shed 71, substantially as shown in FIG. 2.

Due to the particular structure of collar 31 (FIG. 1) including the flange 33, voltage potential lines 87 are distributed over a greater portion of the bushing 3, as compared with the lines 85 of the prior art structure (FIG. 2) which are confined to a smaller area of the bushing 63.

It was further found that if the flange 33 (FIG. 1) of the collar 31 were extended around and over the surface of the lower shed 91, the lines 87 were not as extensively distributed. That is, the lines 87 were confined more to the lower-most sheds.

Figure 1:
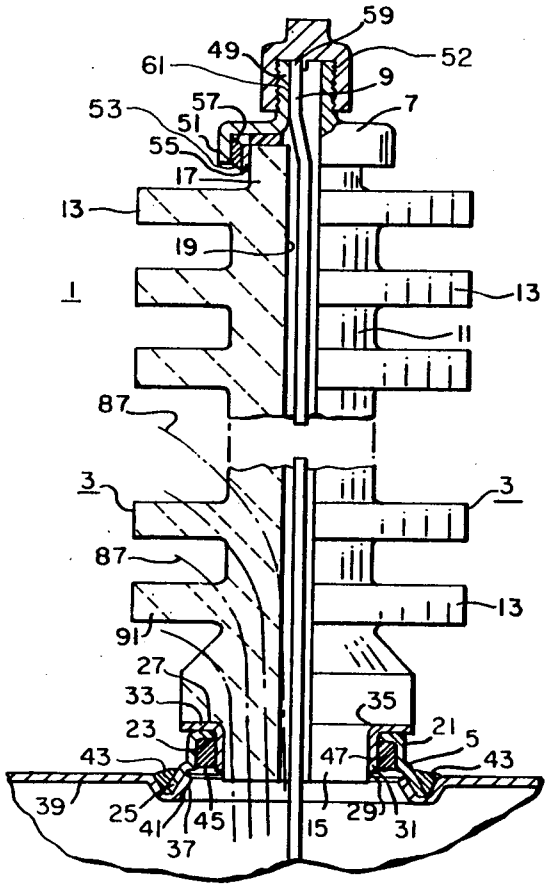
FIG. 1 is an elevational view, partly in section, of the bushing assembly of the present invention.

As a result of the collar structure of FIG. 1, a more equitable division of voltage occurs over the bushing and an improved electrical performance obtains. In turn, a smaller bushing may be used.

The bushing 3 is made of a considerably smaller diameter than heretofore with more sheds 13 to obtain the required external creepage. The design of the cap 7 and the end portion 17 enables the solder to move outwardly to a larger diameter where it blends with the porcelain shank in a feathering process that significantly improves test results.

For example, a 12-inch creep porcelain bushing in accordance with this invention comprises improvements as follows:

| | % Increase |
|---|---|
| D.C. Overpot | 22 |
| 60 Second Dry | 7 |
| 10 Second Wet | 30 |
| R.I. (kV @ 250 uV) (radio interference voltage) | 105 |

Higher voltage designs with 18", 22", or 28" creep are also possible. Since the sheds are smaller and closer together, then shorter designs for the same creep are possible.

Accordingly, the bushing assembly and method for producing the same provide an improved design of porcelain bushings which are substantially smaller, easier to produce, and have substantial improvements in performance.

We claim:

1. An insulating bushing assembly for extending through an aperture in a wall of electrical apparatus, comprising:

(a) an electrically insulating bushing having opposite ends and a longitudinal bore extending between the ends;

(b) the bushing having a reduced end portion forming an annular shoulder surface in a plane substantially normal to the axis of the bore;

(c) the reduced end portion having a peripheral cylindrical surface extending from and forming a circular corner with the annular shoulder surface;

(d) an annular metallic collar around and on the peripheral cylindrical surface and including an outturned annular flange on the annular shoulder surface, whereby the outturned annular flange on the annular shoulder surface causes voltage potential lines to be distributed over a greater portion of the bushing than in the absence of the metallic collar;

(e) a metallic adapter around the collar and having an annular portion concentric with the peripheral cylindrical surface and forming therewith an annular groove;

(f) the annular portion comprising an inturned part in contact with the outturned annular flange;

(g) a metallic bonding material in the annular groove joining the collar and the adapter; and (h) the adapter including an outwardly flared portion adapted for joining with the wall forming the aperture.

2. The bushing assembly of claim 1 in which the bonding material is solder.

3. The bushing assembly of claim 2 in which the bushing includes a second reduced end portion and having a second metallic collar therearound.

4. The bushing assembly of claim 3 in which a cap having a cylindrical flange is mounted on the second reduced end portion and in electrical contact with the second collar.

5. The bushing assembly of claim 4 in which solder is disposed between the cylindrical flange and the second collar.

* * * * *